US012781575B2

(12) United States Patent
Velez et al.

(10) Patent No.: US 12,781,575 B2
(45) Date of Patent: Nov. 3, 2026

(54) MOBILE RIG TO WELL ALIGNMENT SYSTEM AND METHOD

(71) Applicant: Cudd Pressure Control, Inc., The Woodlands, TX (US)

(72) Inventors: Juan Velez, Montgomery, TX (US); Dustin Locklear, Moore, OK (US); Roger L. Schultz, Ninnekah, OK (US); Andrew M. Ferguson, Moore, OK (US)

(73) Assignee: CUDD PRESSURE CONTROL, INC., The Woodlands, TX (US)

( * ) Notice: Subject to any disclaimer, the term of this patent is extended or adjusted under 35 U.S.C. 154(b) by 0 days.

(21) Appl. No.: 19/303,961

(22) Filed: Aug. 19, 2025

(65) Prior Publication Data

US 2026/0055671 A1 Feb. 26, 2026

Related U.S. Application Data

(60) Provisional application No. 63/685,231, filed on Aug. 20, 2024.

(51) Int. Cl.
*E21B 15/04* (2006.01)
*E21B 7/02* (2006.01)
(Continued)

(52) U.S. Cl.
CPC ..... *E21B 15/045* (2013.01); *E21B 7/023* (2013.01); *E21B 15/00* (2013.01); *E21B 19/165* (2013.01); *E21B 19/24* (2013.01); *E21B 33/03* (2013.01)

(58) Field of Classification Search
CPC ..... E21B 7/023; E21B 15/00; E21B 15/045
See application file for complete search history.

(56) References Cited

U.S. PATENT DOCUMENTS 3,508,409 A 4/1970 Cargile, Jr.
4,290,495 A * 9/1981 Elliston ..... E21B 19/084 173/147
(Continued)

FOREIGN PATENT DOCUMENTS

CA 2950920 A1 6/2017
CA 3008007 A1 6/2017
(Continued)

OTHER PUBLICATIONS

Office Action issued Jan. 30, 2026 for U.S. Appl. No. 19/304,016, 18 pages.
(Continued)

*Primary Examiner* — David Carroll
(74) *Attorney, Agent, or Firm* — Smith IP Services, P. C.

(57) ABSTRACT

A well rig can include a mast, and a strut assembly connected to the mast for transmitting a compressive load between the mast and a wellhead assembly, the strut assembly including an anchor that connects to an upper flange of the wellhead assembly. A method of aligning a well rig with a wellhead assembly can include raising a mast of the well rig, and deploying a strut assembly, thereby positioning an anchor relative to the mast. Another well rig can include a mast, and a strut assembly connected to the mast and including struts that transmit a compressive load between the mast and a wellhead assembly, the strut assembly further including an anchor that connects to the wellhead assembly, and the anchor including a rotatable flange body.

29 Claims, 8 Drawing Sheets

(51) Int. Cl.

| | |
|---|---|
| ***E21B 15/00*** | (2006.01) |
| ***E21B 19/16*** | (2006.01) |
| ***E21B 19/24*** | (2006.01) |
| ***E21B 33/03*** | (2006.01) |

(56) References Cited

U.S. PATENT DOCUMENTS

| | | | | |
|---|---|---|---|---|
| 6,283,203 | B1 | 9/2001 | Eilertsen | |
| 8,733,213 | B2 | 5/2014 | Taggart | |
| 9,238,947 | B2 * | 1/2016 | Kallal | E21B 19/16 |
| 9,316,056 | B1 * | 4/2016 | Smith | E21B 7/28 |
| 10,711,523 | B2 | 7/2020 | Taggart et al. | |
| 2005/0126790 | A1 | 6/2005 | Beato et al. | |
| 2013/0341038 | A1 * | 12/2013 | Flusche | E21B 19/00 166/85.1 |
| 2014/0076583 | A1 | 3/2014 | Robichaux et al. | |
| 2017/0314345 | A1 | 11/2017 | Flusche et al. | |
| 2018/0023346 | A1 * | 1/2018 | Taggart | E21B 19/083 175/57 |
| 2018/0100378 | A1 | 4/2018 | Hardy | |
| 2020/0199976 | A1 | 6/2020 | Stahl et al. | |
| 2026/0055670 | A1 | 2/2026 | Velez et al. | |
| 2026/0055676 | A1 * | 2/2026 | Velez | E21B 15/045 |

FOREIGN PATENT DOCUMENTS

| | | | |
|---|---|---|---|
| CA | 2952071 | A1 | 8/2017 |
| CA | 2958393 | A1 | 4/2018 |

OTHER PUBLICATIONS

Office Action issued Jan. 30, 2026 for U.S. Appl. No. 19/304,060, 17 pages.

AEI Supplies, "Snubbing Units", product description, 8 pages, dated Jun. 20, 2024.

National Oilwell Varco, "Hydra Rig(TM) Short Stroke Snubbing Unit", product brochure, 1 page dated 2017.

Prostar Energy, "Company Overview Jun. 2024", presentation, 25 pages, dated Jun. 2024.

* cited by examiner

MOBILE RIG TO WELL ALIGNMENT SYSTEM AND METHOD

CROSS-REFERENCE TO RELATED APPLICATION

This application claims the benefit of the filing date of U.S. provisional application No. 63/685,231 filed on 20 Aug. 2024. The entire disclosure of the prior application is incorporated herein by this reference for all purposes.

BACKGROUND

This disclosure relates generally to equipment utilized and operations performed in conjunction with a subterranean well and, in an example described below, more particularly provides for alignment of a mobile well rig to a well.

When performing well operations using a mobile well rig, a tubular string is typically displaced into and/or out of a well. It is important that the tubular string be properly aligned with a wellhead assembly to facilitate running the tubular string into and out of the well.

Therefore, it will be readily appreciated that improvements are continually needed in the art of constructing and utilizing well rigs. The present disclosure provides such improvements, which may be used with a variety of different types of well operations.

DETAILED DESCRIPTION

Figure 1:
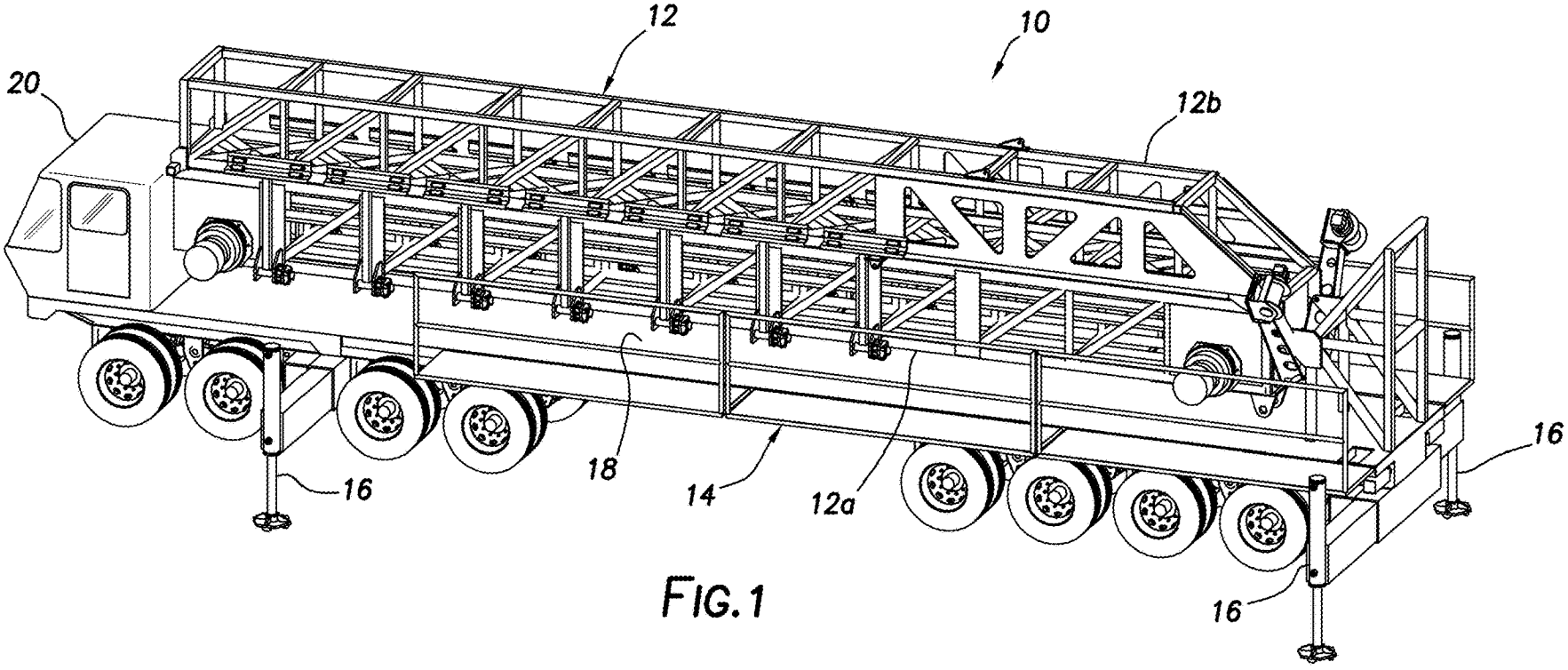
FIG. 1 is a representative perspective view of an example of a mobile well rig and associated method which can embody principles of this disclosure.

Representatively illustrated in FIG. 1 is a well rig 10 and associated method which can embody principles of this disclosure. However, it should be clearly understood that the rig 10 and method are merely one example of an application of the principles of this disclosure in practice, and a wide variety of other examples are possible. Therefore, the scope of this disclosure is not limited at all to the details of the rig 10 and method described herein and/or depicted in the drawings.

In one aspect of the present disclosure, a system that can be fully integrated into a service rig is disclosed, which in one example consists of an apparatus to align and secure the rig to a top flange mount of a wellhead assembly, and a structural apparatus to support and anchor the rig to the wellhead assembly. The system can be particularly useful in well operations in which tubulars are "snubbed" into or out of the well (although this disclosure is not limited to snubbing operations).

A rig assist snubbing unit offers a cost-effective solution for running or pulling tubing in and out of a pressurized wellbore under what is considered live well intervention operations, avoiding the risk of formation damage caused by kill fluid. This enables operators to maintain production during such operations, for example.

Although rig assist snubbing units are cost effective, there is a considerable amount of concern for personnel safety due to the conditions personnel are exposed to during operation of the unit. Typically, rig assist units require two or more personnel to work very near the center of the wellbore right under the rig elevators, exposing the personnel to fall hazards and other hands-on related injuries. However, a drawback to conventional workover and/or drilling rigs is an inability to properly anchor the rig to the wellhead. Rig weight by itself may not be sufficient to fully resist snubbing loads safely at high pressures.

Some features disclosed herein can include (but are not limited to) a wellhead mount and anchoring system to structurally secure the rig to the wellhead, for example, to resist snub loads. In one embodiment, a wellhead securement system is structurally integrated into the rig structure to enable a rigid anchor connection between the rig and wellhead to resist snubbing loads that exceed rig weight.

The wellhead mount and anchoring system can comprise structural tie-back points to allow additional anchor reinforcement via beams, struts, stiff arms, guy wire, chains, boom lines and/or ground anchors. A strut can be provided to extend between the rig (such as, at a rear of a transport) and the wellhead (such as, at a flange of a blowout preventer stack), in order to prevent the rig from displacing toward the wellhead when large snubbing loads are encountered.

The wellhead mount system is integrated with the wellhead assembly, such that wellbore pressure is contained. The anchor may include a flange that is connected between an upper flange of the blowout preventer stack and a lower flange of a lubricator.

In one example, tie back cables or other tensile members are connected between the anchor and the mast (such as, at an underside of a stripping stack walk-around platform). The cables may be connected at laterally extending "ears" or posts of the anchor, permitting the cables to rotate about the ears.

In one example of the mobile well rig, a two-section jointed mast can comprise an ultra heavy-duty motor and conveyor system integrated into an upper mast section to snub tubulars connected to a top drive. When stowed on a transport vehicle an upper mast section is positioned below a lower mast section. During rig-up, both sections are raised to an upright position such that the upper mast is behind (on a tractor side of the vehicle) the lower section with the rear of the vehicle facing the wellhead.

The upper mast section is then rotated about an axis positioned at the top of the lower mast such that the upper mast folds outward and towards the wellhead, and is locked in place once upright. If the well is a slant well (in which the wellbore is inclined from vertical at the surface), the upper and lower masts may be positioned in an appropriately inclined position when extended.

The snubbing function is provided with multiple high torque electrical servo motors—two at each end of the chain conveyor assembly. A carriage is attached to the chain assembly which slides up and down a track integrated with the upper mast section. The top drive is mounted to the carriage once the mast apparatus is in the vertical upright position (or an inclined position for a slant well).

In one embodiment, a lubricator system is mounted above a wellhead blowout preventer stack for lubricating tools into the wellbore safely under pressure. A stripping blowout preventer stack is connected above the lubricator.

The stripping blowout preventer stack is used to contain wellbore pressures while snubbing tubulars into the wellbore. The stripping blowout preventer stack can comprise an annular blowout preventer, two or more slip/safety ram blowout preventers, a center drill spool, valves and an equalization loop.

Referring specifically now to FIG. 1, a representative perspective view of an example of the mobile well rig 10 and associated method is depicted. In this example, the mobile well rig 10 comprises a mast 12 mounted on a transport vehicle 14.

As depicted in FIG. 1, the rig 10 is appropriately positioned proximate a wellhead (not shown in FIG. 1, see FIG. 4), and outriggers 16 of the transport vehicle 14 have been deployed to support a generally horizontal bed or platform 18 on which the mast is pivotably mounted. The mast 12 is stored for transport on the platform 18 rearward of a cab 20 of the transport vehicle 14.

The mast 12 is in a folded configuration as depicted in FIG. 1. An upper section 12*a* of the mast 12 is positioned between the platform 18 and a lower section 12*b* of the mast.

Figure 2:
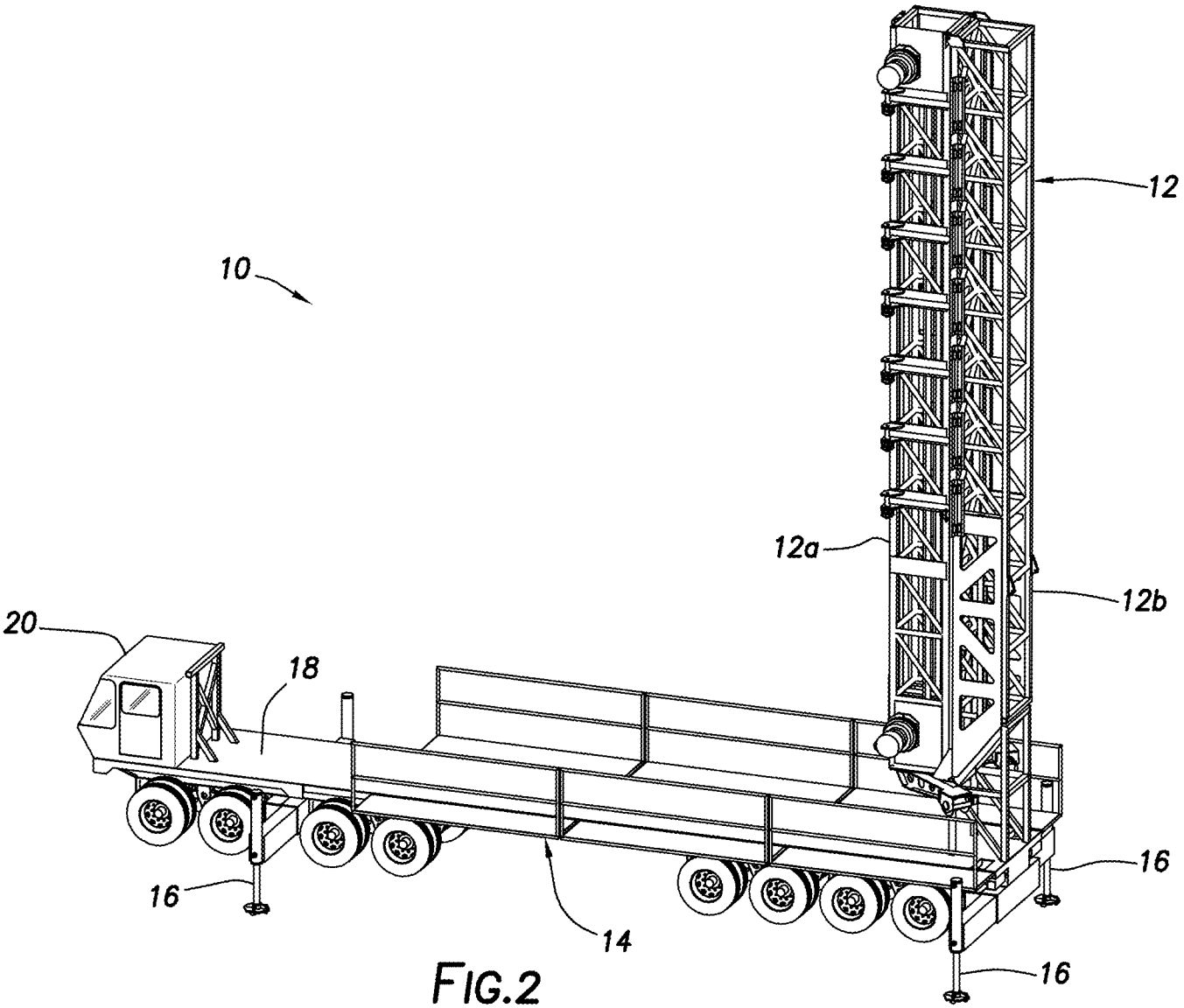
FIG. 2 is a representative perspective view of the rig, with a mast of the rig partially raised.

Referring additionally now to FIG. 2, a representative perspective view of the rig 10, with the mast 12 partially raised is depicted. In this view, the lower mast section 12*b* has been pivoted upward from the platform 18, so that the lower mast is now vertical. In some examples, the lower mast section 12*b* could be raised to an inclined position relative to the platform 18 (such as, when used with a slant well).

Note that the upper mast section 12*a* is also in a vertical orientation at this point as depicted in FIG. 2, although it remains folded against the lower mast section 12*b*. The upper mast section 12*a* is positioned between the lower mast section 12*b* and the cab 20 of the transport vehicle 14.

Figure 3:
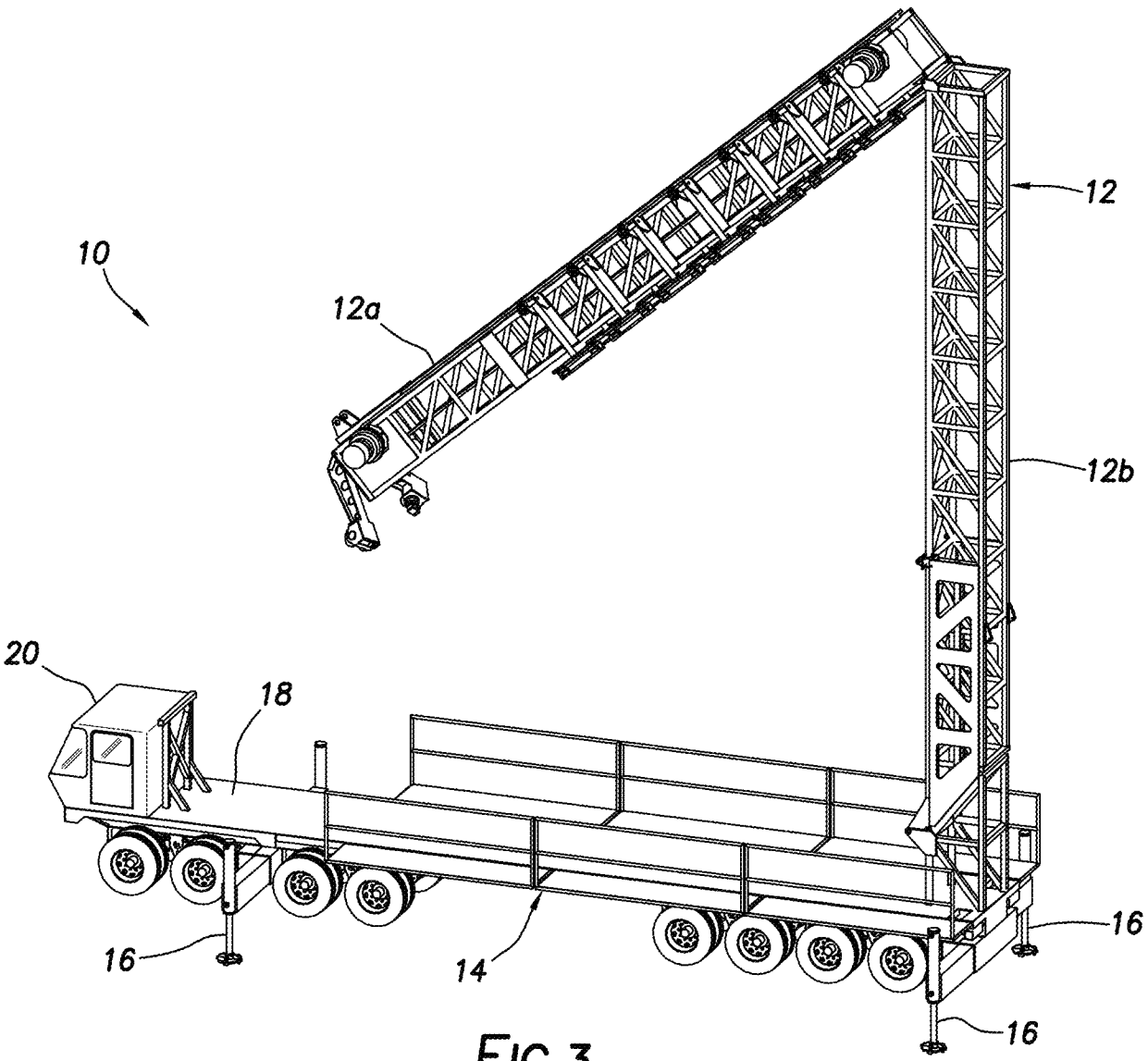
FIG. 3 is a representative perspective view of the rig, with the mast further raised.

Referring additionally now to FIG. 3, a representative perspective view of the rig 10, with the mast 12 further raised is depicted. In this view, the upper mast section 12*a* is being pivoted upward relative to the lower mast section 12*b*. When fully raised, the upper mast section 12*a* will be vertical (in this example) and aligned with the lower mast section 12*b*.

Figure 4:
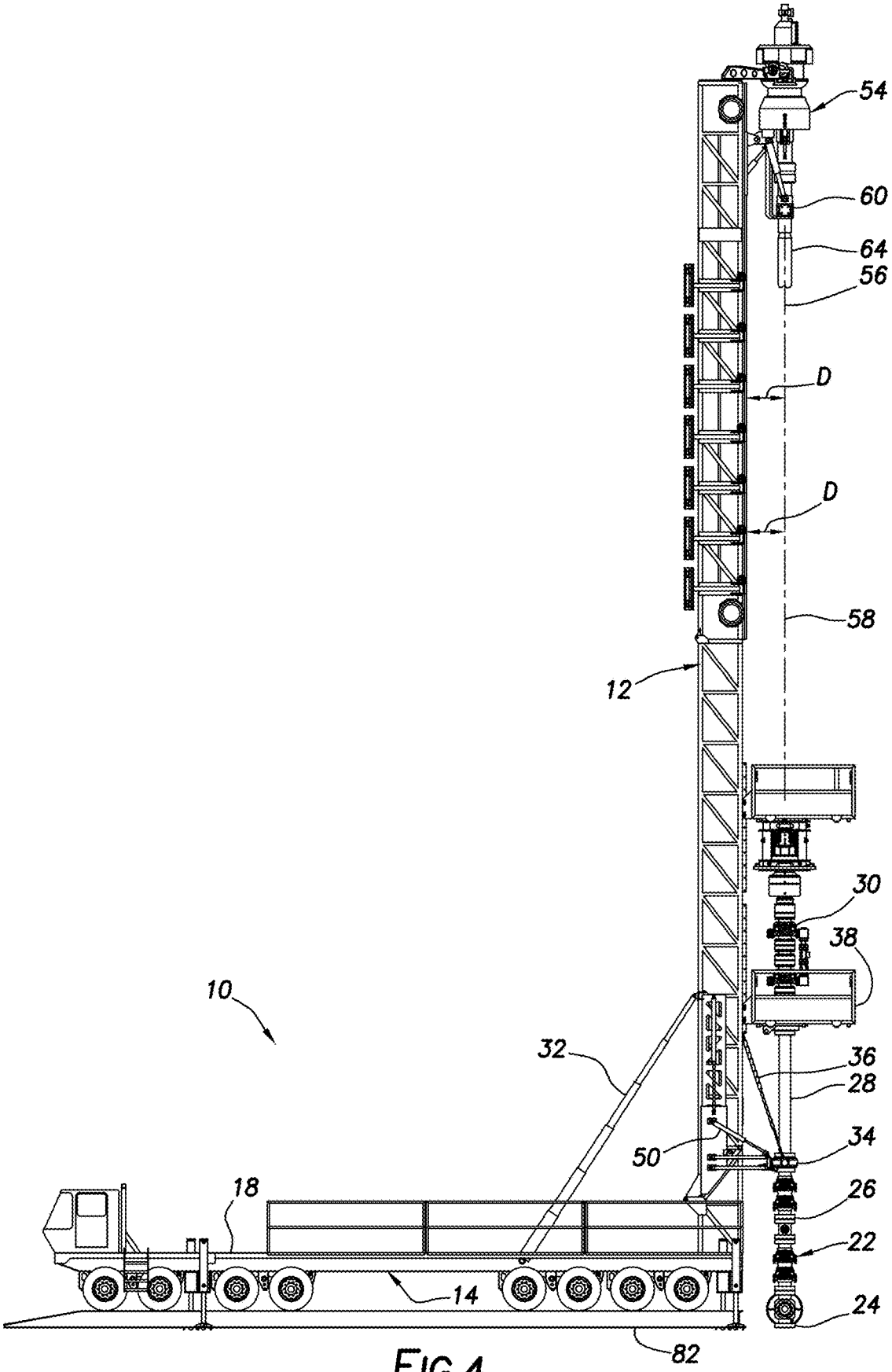
FIG. 4 is a representative side view of the rig with the mast fully raised and secured to a wellhead assembly.

Referring additionally now to FIG. 4, a representative perspective view of another example of the rig 10, with the mast 12 fully raised and secured to a wellhead assembly 22 is depicted. Hydraulic cylinders 32 or other suitable equipment (such as, a crane, a winch system, etc.) may be used to raise the mast 12.

In this view, it may be seen that the wellhead assembly 22 is connected above a wellhead 24 and includes a blowout preventer stack 26, a lubricator 28 and a stripping blowout preventer stack 30. Other equipment (such as, a slip bowl assembly) may be connected above the stripping blowout preventer stack 30 in some examples.

The lubricator 28 and stripping blowout preventer stack 30 are useful for containing well pressure when snubbing tubulars 64 into and out of the well. If snubbing operations are not anticipated, these components may not be used, or other components not designed for use with snubbing operations may be used.

An anchor 34 is connected to the wellhead assembly 22 in order to secure the mast 12 against inadvertent movement due, for example, to snubbing loads on the tubulars 64 run into or out of the well using the rig 10. The rig 10 in this example uses a top drive 54 to run the tubulars, and so the top drive will transfer snubbing loads from the tubulars to the mast 12.

It is preferred in this example for a rotational axis 56 of the top drive 54 to be vertically and coaxially aligned with an axis 58 of the wellhead assembly 22. In the example of a slant well, the axes 56, 58 would be coaxially aligned, but not vertical.

The rotational axis 56 of the top drive 54 may be an axis about which a tubular 64 is rotated with a quill 60 of the top drive connected to the tubular. The axis 58 of the wellhead assembly 22 may be an axis of a central fluid passage 62 (not visible in FIG. 4, see FIG. 8) extending through the wellhead assembly.

Figure 5:
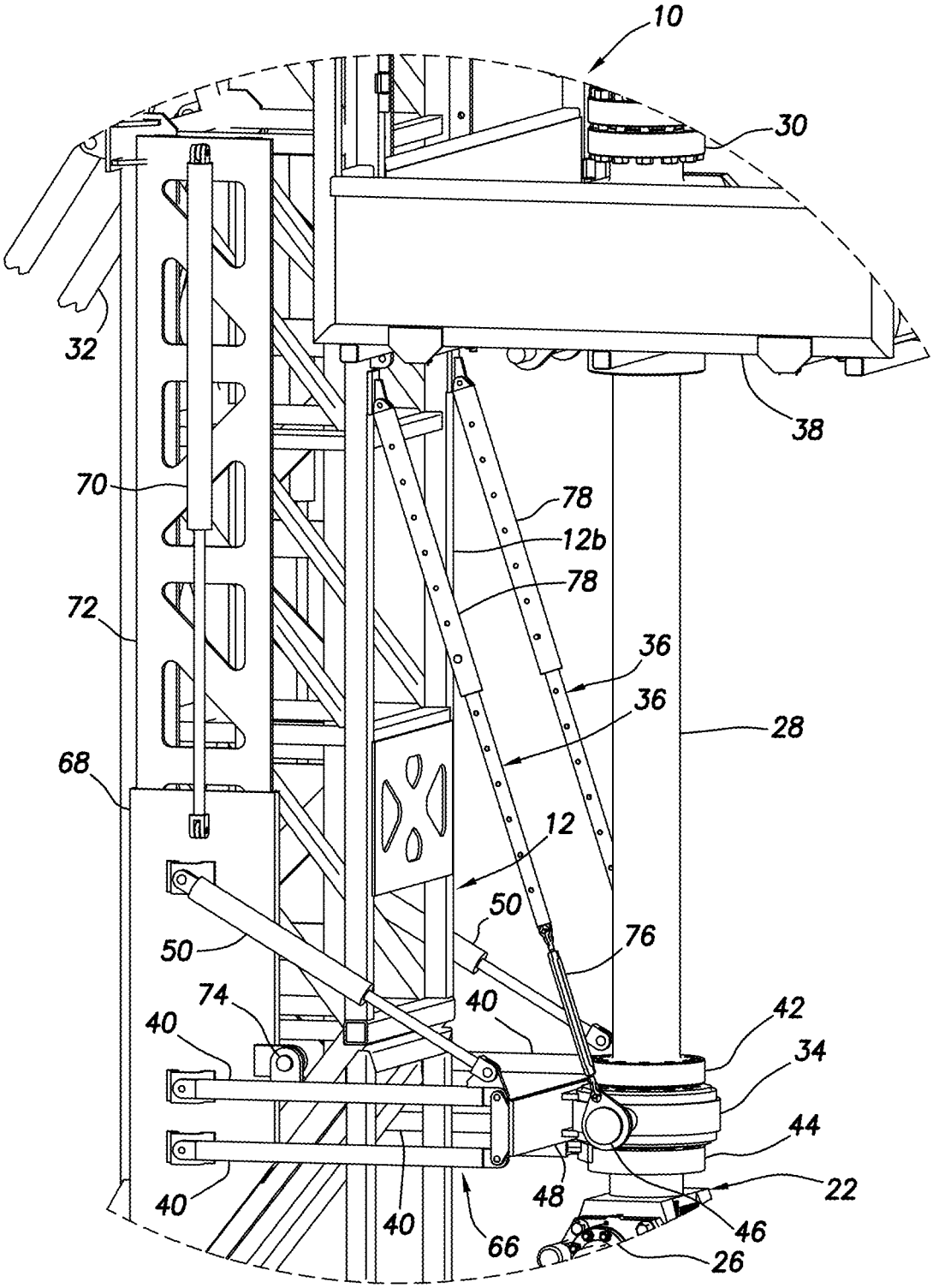
FIG. 5 is a representative perspective view of a strut assembly and tensile members of the rig.

Referring additionally now to FIG. 5, a representative perspective view of an example of a strut assembly 66 and tensile members 36 of the rig 10 is depicted. In this view it may be seen that the strut assembly 66 has been deployed to align the anchor 34 with the wellhead assembly 22, in order to connect the anchor 34 between the lubricator 28 and the wellhead assembly, and to transmit compressive loads between the wellhead assembly and the mast 12 of the rig 10.

The tensile members 36 are connected between the anchor 34 and the mast 12 to transfer tensile loads from the mast to the anchor (and thence to the wellhead assembly 22). The tensile members 36 may be in the form of cables, chains, rods or braces, and may in some examples include features for applying a tensile pre-load between the mast 12 and the anchor 34.

In this example, an upper end of each tensile member 36 is pivotably connected directly to the mast 12 below a platform 38 positioned adjacent the stripping blowout preventer stack 30. A lower end of each tensile member 36 is pivotably connected to posts 46 of the anchor 34. In other examples, the upper ends of the tensile members 36 may be connected indirectly to the mast 12, (e.g., to an underside of the platform 38, which is connected directly to the mast).

Struts 40 are connected between the anchor 34 and a carriage 68 slidably mounted on the mast 12. In the FIG. 5 example, on each lateral side of the mast 12, a carriage 68 is displaceable by a hydraulic cylinder 70 along a track 72 secured to the mast.

The struts 40 transfer compressive loads between the mast 12 and the anchor 34, in order to prevent the rig 10 from being moved toward the wellhead assembly 22 when substantial snubbing loads are applied. The carriage 68 and track 72 enable an axial position of the anchor 34 to be adjusted when the strut assembly 66 is deployed, so that the anchor is appropriately positioned above the wellhead assembly 22.

As depicted in FIG. 5, the tensile members 36 and struts 40 are used to secure the rig 10 relative to the wellhead assembly 22. The anchor 34 is configured to connect between flanges 42, 44. In this example, the flange 42 is a lower flange of the lubricator 28, and the flange 44 is an upper flange of the blowout preventer stack 26.

Ears or horizontal posts 46 (only one of which is visible in FIG. 5) extend laterally outward from the anchor 34. The lower ends of the tensile members 36 are pivotably connected to the posts 46.

A beam 48 extends laterally outward on a side of the anchor 34 facing toward the mast 12. An outer end of each of the struts 40 is pivotably connected to the beam 48. The other end of each strut 40 is pivotably connected to the respective carriage 68, which is displaceable along the track 72 on the lower mast 12*b* by the hydraulic cylinder 70.

Hydraulic cylinders 50 can be used to adjust rotational positions of the struts 40 relative to the beam 48. In this example, the hydraulic cylinders 50 are used to pivot the struts 40, anchor 34 and beam 48 of the strut assembly 66 outward relative to the mast 12. One or more electric motors may be substituted for the hydraulic cylinders in other examples.

At a desired position, the strut assembly 66 is secured relative to the mast 12 (for example, by installing pins 74 that prevent further rotation of the struts 40 relative to the carriage 68). In this desired position, the anchor 34 is coaxial with the quill 60 of the top drive 54 (see FIGS. 4 & 6; the central bore 62 in the anchor 34 is aligned with the rotational axis 56 of the top drive, and a distance D between the central bore 62 in the anchor 34 and the mast 12 is equal to the distance between the rotational axis 56 of the top drive and the mast 12) in this example.

As depicted in FIG. 5, each of the tensile members 36 comprises a turnbuckle 76 and a telescoping adjuster 78. The telescoping adjuster 78 provides for relatively quick adjustment of a length of a tensile member 36, and the turnbuckle 76 provides for applying a tensile preload to the tensile member after the anchor 34 has been secured between the flanges 42, 44.

Figure 6:
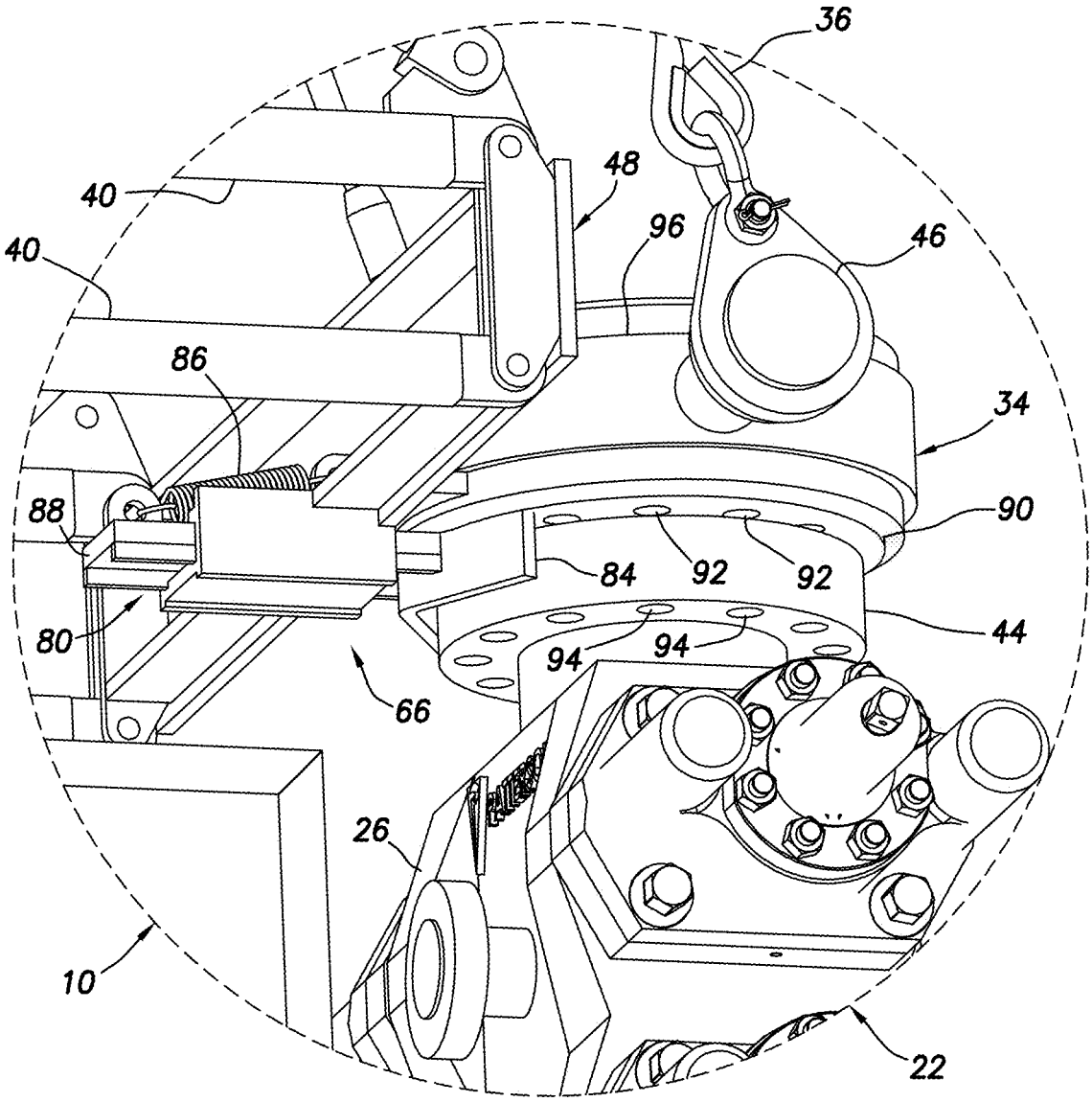
FIG. 6 is a representative lower perspective view of an alignment guide and anchor of the strut assembly.

Referring additionally now to FIG. 6, a representative lower perspective view of an example of an alignment guide 80 and the anchor 34 of the strut assembly 66 is depicted. In this view, the strut assembly 66 is being laterally aligned with the upper flange 44 of the wellhead assembly 22.

As discussed above, the struts 40, beam 48 and anchor 34 of the strut assembly 66 have been rotated outward from the mast 12 and locked in position (for example, using the pins 74, see FIG. 5). The rig 10 is then moved toward the wellhead assembly 22 (for example, by moving the transport vehicle 14 or a substructure 82 on which the vehicle is positioned, see FIGS. 1-4), until the alignment guide 80 engages the upper flange 44 of the wellhead assembly 22.

In the FIG. 6 example, the alignment guide 80 comprises a V-shaped engagement member 84 that laterally aligns the anchor 34 with the wellhead assembly 22 by engaging a circular curvature of an outer diameter of the flange 44. The engagement member 84 is resiliently biased rearward (toward the wellhead assembly 22) by a spring 86 connected between the beam 48 and a slide 88 to which the engagement member is secured.

As depicted in FIG. 6, the anchor 34 includes a flange body 90 that is rotatable to align bolt holes 92 in the flange body with respective bolt holes 94 in the flange 44. In this example, the flange body 90 is rotatable in an outer ring 96 to which the ears 46 are secured.

Figure 7:
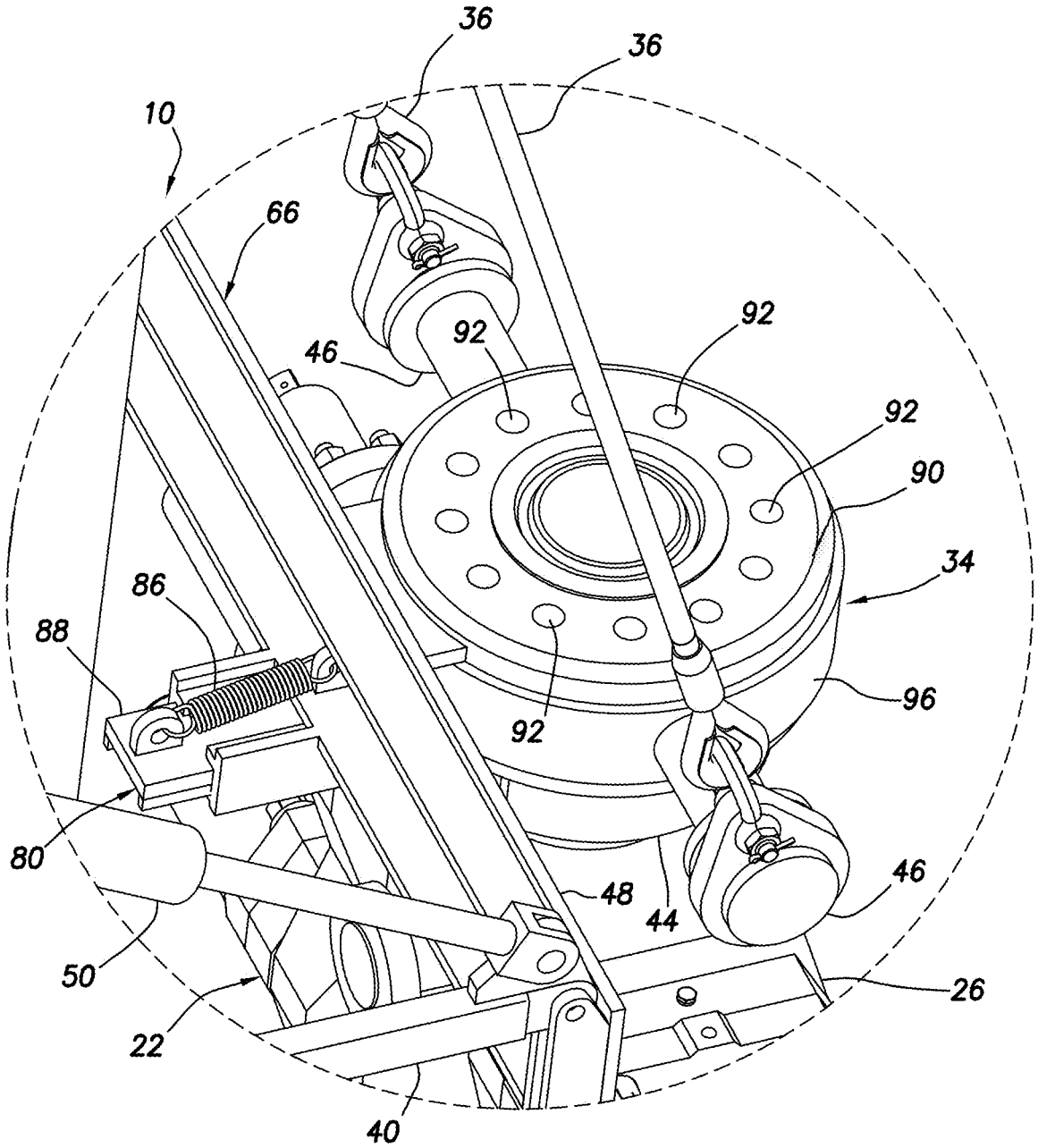
FIG. 7 is a representative upper perspective view of the alignment guide and anchor of the strut assembly.

Referring additionally now to FIG. 7, a representative upper perspective view of the alignment guide 80 and anchor 34 of the strut assembly 66 is depicted. In this view, the flange body 90 of the anchor 34 has been rotated relative to the outer ring 96, so that the bolt holes 92 in the flange body are aligned with the respective bolt holes 94 (see FIG. 6) in the upper flange 44 of the wellhead assembly 22.

In this example, the outer ring 96 is secured to the beam 48. Thus, the flange body 90 is rotatable relative to the beam 48 and the outer ring 96.

Figure 8:
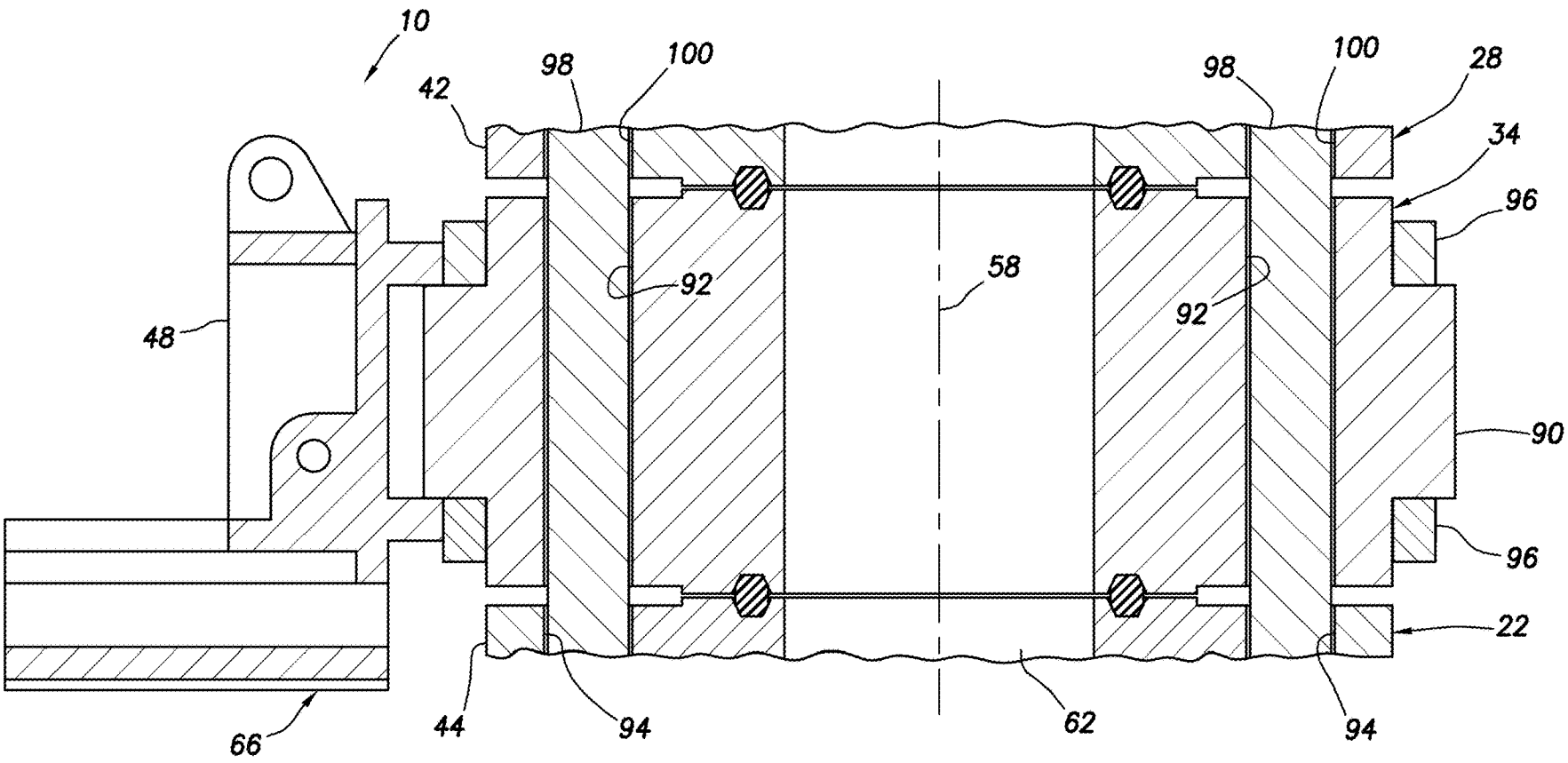
FIG. 8 is a representative cross-sectional view of the anchor secured between the wellhead assembly and a lubricator.

Referring additionally now to FIG. 8, a representative cross-sectional view of an example of the anchor 34 secured between the wellhead assembly 22 and the lubricator 28 is depicted. In this view, the flange body 90 is secured between the lower flange 42 of the lubricator 28 and the upper flange 44 of the wellhead assembly 22.

As depicted in FIG. 8, studs, bolts 98 or other fasteners are installed through respective bolt holes 92, 94, and bolt holes 100 extending through the lower flange 42. The bolts 98 are tightened to secure and seal the flange body 90 between the flanges 42, 44. The axis 58 and central bore 62 extend through each of the wellhead assembly 22, the anchor 34 and the lubricator 28.

In an example method of aligning the well rig 10 with the wellhead assembly 22, the rig 10 is positioned adjacent the wellhead assembly, for example, by driving the vehicle 14 onto the substructure 82 positioned proximate the wellhead 24 on which the wellhead assembly is mounted. The substructure 82 may be provided with tracks or walking "feet" that permit movement of the substructure after the rig 10 has been driven onto the substructure.

The mast 12 is raised as described above. The upper and lower mast sections 12*a,b* are rotated relative to the platform 18 to a vertical position (see FIG. 2), and then the upper mast section is rotated relative to the lower mast section to a vertical position (see FIG. 4). The top drive 54 is installed on the upper mast section 12*a*.

The strut assembly 66 is operated to position the anchor 34 appropriately relative to the wellhead assembly 22. The carriages 68 are displaced along the tracks 72 to adjust a height of the strut assembly 66, and the hydraulic cylinders 50 are used to rotate the struts 40, beam 48, anchor 34 and alignment guide 80 outward relative to the mast 12.

When the axis 58 of the central fluid passage 62 in the anchor 34 is aligned with the rotational axis 56 of the top drive 54, the struts 40, beam 48, anchor 34 and alignment guide 80 are secured against further rotation (for example, by installing the pins 74). The tensile members 36 are connected between the mast 12 and the anchor 34.

The rig 10 is moved toward the wellhead assembly 22 (for example, by driving the vehicle 14 rearward, or by displacing the substructure 82 toward the wellhead 24) to engage the alignment guide 80 with the upper flange 44. The strut assembly 66 and the mast 12 are, thus, laterally aligned with the wellhead assembly 22. In some examples, the substructure 82 may be displaced laterally, if needed, to laterally align the strut assembly 66 and the mast 12 with the wellhead assembly 22.

The flange body 90 of the anchor 34 is rotated as needed to align the respective bolt holes 92, 94. The lubricator 28 is positioned above the flange body 90 and the bolt holes 100 are aligned with the respective other bolt holes 92, 94. The bolts 98 are installed in the bolt holes 92, 94, 100 and are tightened.

The anchor 34 is now secured between the wellhead assembly 22 and the lubricator 28. The axis 58 of the wellhead assembly 22 is aligned with the rotational axis 56 of the top drive 54. The strut assembly 66 is configured to transmit compressive loads between the wellhead assembly 22 and the mast 12, in order to prevent movement of the mast toward the wellhead assembly.

In some examples, the lengths of the tensile members 36 can be adjusted to apply a tensile preload to the tensile members (for example, by tightening the turnbuckles 76 to shorten the tensile members, after making gross length adjustments if needed using the telescoping adjusters 78). This will bias the mast 12 downward relative to the wellhead assembly 22 (for example, to enhance resistance to snub loads and prevent movement of the mast upward relative to the wellhead assembly), while the strut assembly 66 prevents movement of the mast horizontally toward the wellhead assembly.

It may now be fully appreciated that the above disclosure provides significant benefits to the art of constructing and utilizing well rigs. In examples described above, the anchor 34 and the top drive 54 can be accurately, conveniently and efficiently coaxially aligned with the wellhead assembly 22. A described strut assembly 66 is used to secure the mast 12 to the wellhead assembly 22.

The present disclosure provides to the art a well rig 10. In one example, the well rig 10 can comprise a mast 12, and a strut assembly 66 connected to the mast 12 and configured to transmit a compressive load between the mast 12 and a wellhead assembly 22, the strut assembly 66 comprising an anchor 34 configured to connect to an upper flange 44 of the wellhead assembly 22.

The mast 12 may comprise upper and lower mast sections 12*a,b*, the upper mast section 12*a* being pivotable relative to the lower mast section 12*b*.

The well rig 10 may include a top drive 54 displaceable along the mast 12. The strut assembly 66 may be lockable in a position in which a rotational axis 56 of the top drive 54 is aligned with an axis 58 of a central fluid passage 62 in the anchor 34.

The anchor 34 may be configured to be secured between the upper flange 44 of the wellhead assembly 22 and a lower flange 42 of a lubricator 28. The anchor 34 may include a rotatable flange body 90 having first holes 92 configured to align with respective second holes 94 of the upper flange 44. The strut assembly 66 may include multiple struts 40 rotatable relative to the mast 12, and a beam 48 connected between the struts 40 and the anchor 34, the flange body 90 being rotatable relative to the beam 48.

The strut assembly 66 may include multiple struts 40 rotatable relative to a carriage 68 displaceable along a track 72 secured to the mast 12. The strut assembly 66 may be lockable against rotation relative to the carriage 68 in a position in which a rotational axis 56 of the top drive 54 is aligned with an axis 58 of a central fluid passage 62 in the anchor 34.

The strut assembly 66 may include an alignment guide 80 configured to engage the upper flange 44 and laterally align the anchor 34 with the upper flange 44. The well rig 10 may include at least one tensile member 36 configured to transmit a tensile load between the mast 12 and the anchor 34.

The present disclosure also provides to the art a method of aligning a well rig 10 with a wellhead assembly 22. In one example, the method can include raising a mast 12 of the well rig 10, and deploying a strut assembly 66 of the well rig 10, thereby positioning an anchor 34 of the strut assembly 66 relative to the mast 12.

The deploying step may include rotating struts 40 of the strut assembly 66 relative to the mast 12. The rotating may include rotating the struts 40 relative to a carriage 68 displaceable along a track 72 secured to the mast 12.

The deploying step may include locking the struts 40 in a rotational position in which an axis 58 of a central fluid passage 62 in the anchor 34 is aligned with a rotational axis 56 of a top drive 54 displaceable along the mast 12. The method may include the struts 40 transmitting a compressive load between the mast 12 and the wellhead assembly 22.

The method may include rotating a flange body 90 of the anchor 34, thereby rotationally aligning the flange body 90 with an upper flange 44 of the wellhead assembly 22. The rotationally aligning may include aligning first holes 92 in the flange body 90 with respective second holes 94 in the upper flange 44.

The method may include securing the anchor 34 to the wellhead assembly 22. The securing step may include securing the anchor 34 to an upper flange 44 of the wellhead assembly 22. The securing step may include securing the anchor 34 between the wellhead assembly 22 and a lubricator 28.

The method may include connecting a tensile member 36 to the anchor 34, and transmitting a tensile load between the anchor 34 and the mast 12 via the tensile member 36.

This disclosure also provides to the art an example of a well rig 10, comprising a mast 12, and a strut assembly 66 connected to the mast 12. The strut assembly 66 comprises struts 40 configured to transmit a compressive load between the mast 12 and a wellhead assembly 22, and an anchor 34 configured to connect to the wellhead assembly 22. The anchor comprises a rotatable flange body 90.

The mast 12 may comprise upper and lower mast sections 12*a.b*, with the upper mast section 12*a* being pivotable relative to the lower mast section 12*b*.

The well rig 10 may comprise a top drive 54 displaceable along the mast 12. The strut assembly 66 may be lockable in a position in which a rotational axis 56 of the top drive 54 is aligned with an axis 58 of a central fluid passage 62 in the anchor 34.

The anchor 34 may be configured to be secured between an upper flange 44 of the wellhead assembly 22 and a lower flange 42 of a lubricator 28. First holes 92 in the flange body 90 may be configured to align with respective second holes 94 of an upper flange 44 of the wellhead assembly 22. The strut assembly 66 may comprise multiple struts 40 rotatable relative to the mast 12, and a beam 48 connected between the struts 40 and the anchor 34, the flange body 90 being rotatable relative to the beam 48.

The strut assembly 66 may comprise multiple struts 40 rotatable relative to a carriage 68, the carriage 68 being displaceable along a track 72 secured to the mast 12. The strut assembly 66 may be lockable against rotation relative to the carriage 68 in a position in which a rotational axis 56 of a top drive 54 is aligned with an axis 58 of a central fluid passage 62 in the anchor 34.

The strut assembly 66 may comprise an alignment guide 80 configured to engage an upper flange 44 of the wellhead assembly 22 and laterally align the anchor 34 with the upper flange 44. The well rig 10 may comprise at least one tensile member 36 configured to transmit a tensile load between the mast 12 and the anchor 34.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well rig, comprising:

a mast, the mast comprising upper and lower mast sections, in which the upper mast section is pivotable relative to the lower mast section; and a strut assembly connected to the mast and configured to transmit a compressive load between the mast and a wellhead assembly, the strut assembly comprising an anchor configured to connect to an upper flange of the wellhead assembly.

2. The well rig of claim 1, further comprising a top drive displaceable along the mast, and in which the strut assembly is lockable in a position in which a rotational axis of the top drive is aligned with an axis of a central fluid passage in the anchor.

3. The well rig of claim 1, in which the anchor is configured to be secured between the upper flange of the wellhead assembly and a lower flange of a lubricator.

4. The well rig of claim 1, in which the anchor comprises a rotatable flange body, the flange body having first holes configured to align with respective second holes of the upper flange.

5. The well rig of claim 4, in which the strut assembly comprises multiple struts rotatable relative to the mast, and a beam connected between the struts and the anchor, the flange body being rotatable relative to the beam.

6. The well rig of claim 1, in which the strut assembly comprises multiple struts rotatable relative to a carriage, the carriage being displaceable along a track secured to the mast.

7. The well rig of claim 6, in which the strut assembly is lockable against rotation relative to the carriage in a position in which a rotational axis of a top drive is aligned with an axis of a central fluid passage in the anchor.

8. The well rig of claim 1, in which the strut assembly comprises an alignment guide configured to engage the upper flange and laterally align the anchor with the upper flange.

9. The well rig of claim 1, further comprising at least one tensile member configured to transmit a tensile load between the mast and the anchor.

10. A method of aligning a well rig with a wellhead assembly, the method comprising:

raising a mast of the well rig; and deploying a strut assembly of the well rig, thereby positioning an anchor of the strut assembly relative to the mast, in which the deploying comprises rotating struts of the strut assembly relative to the mast.

11. The method of claim 10, in which the rotating comprises rotating the struts relative to a carriage displaceable along a track secured to the mast.

12. The method of claim 10, in which the deploying further comprises locking the struts in a rotational position in which an axis of a central fluid passage in the anchor is aligned with a rotational axis of a top drive displaceable along the mast.

13. The method of claim 10, further comprising the struts transmitting a compressive load between the mast and the wellhead assembly.

14. The method of claim 10, further comprising rotating a flange body of the anchor, thereby rotationally aligning the flange body with an upper flange of the wellhead assembly.

15. The method of claim 14, in which the rotationally aligning comprises aligning first holes in the flange body with respective second holes in the upper flange.

16. The method of claim 10, further comprising securing the anchor to the wellhead assembly.

17. The method of claim 16, in which the securing comprises securing the anchor to an upper flange of the wellhead assembly.

18. The method of claim 16, in which the securing comprises securing the anchor between the wellhead assembly and a lubricator.

19. The method of claim 10, further comprising connecting a tensile member to the anchor, and transmitting a tensile load between the anchor and the mast via the tensile member.

20. A well rig, comprising:

a mast; and a strut assembly connected to the mast, the strut assembly comprising struts configured to transmit a compressive load between the mast and a wellhead assembly, the strut assembly further comprising an anchor configured to connect to the wellhead assembly, and the anchor comprising a rotatable flange body.

21. The well rig of claim 20, in which the mast comprises upper and lower mast sections, the upper mast section being pivotable relative to the lower mast section.

22. The well rig of claim 20, further comprising a top drive displaceable along the mast, and in which the strut assembly is lockable in a position in which a rotational axis of the top drive is aligned with an axis of a central fluid passage in the anchor.

23. The well rig of claim 20, in which the anchor is configured to be secured between an upper flange of the wellhead assembly and a lower flange of a lubricator.

24. The well rig of claim 20, in which first holes in the flange body are configured to align with respective second holes of an upper flange of the wellhead assembly.

25. The well rig of claim 20, in which the strut assembly comprises multiple struts rotatable relative to the mast, and a beam connected between the struts and the anchor, the flange body being rotatable relative to the beam.

26. The well rig of claim 20, in which the strut assembly comprises multiple struts rotatable relative to a carriage, the carriage being displaceable along a track secured to the mast.

27. The well rig of claim 26, in which the strut assembly is lockable against rotation relative to the carriage in a position in which a rotational axis of a top drive is aligned with an axis of a central fluid passage in the anchor.

28. The well rig of claim 20, in which the strut assembly comprises an alignment guide configured to engage an upper flange of the wellhead assembly and laterally align the anchor with the upper flange.

29. The well rig of claim 20, further comprising at least one tensile member configured to transmit a tensile load between the mast and the anchor.

* * * * *